US006558810B2

(12) United States Patent
Garbo

(10) Patent No.: US 6,558,810 B2
(45) Date of Patent: May 6, 2003

(54) FORMING SINTERED METAL FIBER POROUS MATS

(76) Inventor: Paul W. Garbo, 48 Lester Ave., Freeport, NY (US) 11520

( * ) Notice: Subject to any disclaimer, the term of this patent is extended or adjusted under 35 U.S.C. 154(b) by 0 days.

(21) Appl. No.: 09/944,854

(22) Filed: Sep. 4, 2001

(65) Prior Publication Data

US 2002/0028154 A1 Mar. 7, 2002

Related U.S. Application Data

(63) Continuation-in-part of application No. 09/655,215, filed on Sep. 5, 2000, now abandoned.

(51) Int. Cl.[7] ..... B22F 7/04

(52) U.S. Cl. ..... 428/549; 428/550; 419/2; 419/8; 419/9; 431/329

(58) Field of Search ..... 419/2, 8, 9; 75/229; 428/549, 550; 431/329

(56) References Cited

U.S. PATENT DOCUMENTS 3,173,470 A * 3/1965 Wright
3,693,750 A * 9/1972 Takkunen ..... 181/286
4,039,703 A * 8/1977 Kamijo et al. ..... 264/112
4,067,735 A * 1/1978 Bezruk et al. ..... 419/2
4,562,039 A * 12/1985 Koehler ..... 419/2
4,597,734 A * 7/1986 McCausland et al. ... 126/92 AC
4,746,287 A * 5/1988 Lannutti ..... 264/256
4,810,587 A * 3/1989 Losfeld et al. ..... 428/549
4,983,467 A * 1/1991 De Bruyne et al. ..... 428/605
5,080,672 A * 1/1992 Bellis ..... 419/2
5,304,330 A * 4/1994 Tatarchuk et al. ..... 264/104
5,326,631 A * 7/1994 Carswell et al. ..... 162/127
5,568,652 A * 10/1996 Wu ..... 264/432
6,231,792 B1 * 5/2001 Overbeek et al. ..... 264/43
6,365,092 B1 * 4/2002 Backa et al. ..... 264/628

* cited by examiner

*Primary Examiner*—Ngoclan Mai
(74) *Attorney, Agent, or Firm*—Paul W. Garbo

(57) ABSTRACT

Formation of sintered metal fiber porous mats used as burner faces and filters comprises dispersing metal fibers in a viscous aqueous solution of one or more cellulose ethers, vacuum molding the dispersed metal fibers on a foraminous support, eliminating residual aqueous cellulose ether from the vacuum molded metal fiber porous mat, and sintering the mat. Water solutions of methylcellulose and/or hydroxypropyl methylcellulose having a viscosity of at least about 1500 centipoises are often used pursuant to this invention.

27 Claims, No Drawings

FORMING SINTERED METAL FIBER POROUS MATS

This is a continuation in part of application Ser. No. 09/655,215 filed Sep. 5, 2000 now abandoned.

BACKGROUND OF THE INVENTION

This invention relates to a simplified process for producing sintered porous metal fiber mats used as gas burners and filters. More particularly, the invention involves dispersing metal fibers in a viscous aqueous solution and vacuum molding the viscous aqueous metal fiber dispersion prior to sintering the molded metal fibers.

Prior proposals for producing sintered metal fiber gas burners are set forth in U.S. Pat. No. 3,173,470 to Wright, and U.S. Pat. No. 4,597,734 to McCausland et al. While Wright describes the metal fibers and the mat formed thereof in some detail, he has little to say about how to form a uniform layer of the fibers. Specifically, Wright states: Although the manner of forming the sintered fiber mat does not form any part of this invention, one method that can be used is to distribute the previously sized fibers in a uniform layer onto a pallet.

The disclosure of McCausland et al mentions metal fibers that may be woven or randomly packed to form a felt. Specific reference is made to felt panels made according to a proprietary process, trade name Bekipor, from fibers of an iron, chromium and aluminum alloy.

Both patents do not discuss the difficulties of forming a uniform layer or a felt of metal fibers that will have uniform porosity for proper performance as a gas burner or filter. In short, there is need for a simple method of depositing metal fibers as a layer or mat of uniform porosity.

Accordingly, a principal object of this invention is to provide a simple process for depositing metal fibers in layers that can be sintered to provide filters and gas burner elements or faces of uniform porosity.

Another important object is to utilize highly developed technology to lay the metal fibers in mats of uniform porosity.

These and other features and advantages of the invention will be apparent from the description that follows.

SUMMARY OF THE INVENTION

In accordance with this invention, a method of forming porous layers or mats of sintered metal fibers suitable for use as burner faces or as filters comprises the novel and essential steps of dispersing the metal fibers in a viscous water solution of a cellulose ether and vacuum molding the viscous dispersion of metal fibers on a foraminous support. The vacuum molded layer of metal fibers on the foraminous support may be pressed or compacted. Residual cellulose ether is then eliminated from the wet layer of metal fibers by washing or combustion prior to sintering the metal fibers.

Widely practiced, vacuum molding creates a pressure drop across the foraminous support by reducing the pressure on the side opposite that on which the fiber mat is formed. However, as also known, the pressure drop can also be created by increasing the pressure of the viscous dispersion of fibers supplied to the foraminous support. Both methods achieve pressurized filtration of the viscous dispersion of metal fibers with consequent fiber mat formation. while vacuum molding (pressure drop at best about 14.7 pounds per square inch) is generally adequate and favored, forced filtration by pumping the fiber dispersion against the foraminous support at higher pressure may be desirable as with a higher viscosity fiber dispersion. Thus, the invention uses pressurized filtration of the viscous dispersion of metal fibers either by supplying the dispersion to the foraminous support at elevated pressure (e.g., 30 pounds per square inch) or by applying vacuum to the discharge side of the support.

Elimination of cellulose ether from the vacuum molded metal fibers by washing is easily effected by vacuum washing, i.e., drawing clean water through the mat of metal fibers by vacuum. Vacuum washing should be conducted before residual solution of cellulose ether in the metal fiber mat dries because dry cellulose ether is difficult to redissolve. Vacuum washed metal fiber mats are readily prepared for sintering by complete evaporation of residual water. Of course, vacuum washing can be replaced by forced washing, i.e., pumping water at elevated pressure through the metal fiber mat.

Alternative elimination of cellulose ether from vacuum molded metal fibers merely involves subjecting the molded metal fibers to high temperature combustion with excess oxygen to ensure complete combustion of the cellulose ether. Generally, vacuum washing is easier and hence is the preferred way of eliminating residual cellulose ether.

A vacuum molded layer or mat of metal fibers which has been completely freed of residual cellulose ether either by washing or combustion is ready for sintering. The sintering art is well known and varies with the composition of the selected metal fibers. Therefore, no claim of invention is made for sintering, per se. In fact, prior steps in the process, such as vacuum molding, are also well developed procedures. Invention resides in the novel combination of those procedures.

Basic to this invention is the use of one or more water soluble cellulose ethers to form a viscous aqueous solution thereof in which metal fibers can be dispersed so that the aqueous dispersion can be vacuum molded on a foraminous support as a layer of uniform porosity. Water-soluble cellulose ethers have an ether linkage between a cellulose radical and a solubilizing radical. Methylcellulose and hydroxypropyl methylcellulose are commercially prominent water-soluble cellulose ethers available in tonnage quantities. Other examples of water-soluble cellulose ethers are carboxymethyl cellulose, hydroxyethyl cellulose, methyl ethyl cellulose, and ethyl hydroxyethyl cellulose.

Water-soluble cellulose ethers are produced in various viscosity grades. Viscosity grade is the viscosity of a 2% aqueous solution of the cellulose ether measured at 20° C. with an Ubbelohde viscosimeter in millipascal-seconds equivalent to centipoise. For example, hydroxypropyl methylcellulose is sold in various viscosity grades ranging from 15 to 100,000 centipoises.

Ideally, the selected viscosity of the water solution of a cellulose ether used to disperse a chosen type of metal fibers can be attained with a smaller quantity of a higher viscosity grade of that cellulose ether. For example, a 1% water solution of hydroxypropyl methylcellulose having a viscosity grade of 50,000 centipoises has a viscosity of about 1500 centipoises (all viscosities determined at 20° C.). In each case, minimization of cellulose ether consumption, by selection of higher viscosity grade must be weighed against possibly higher price for higher viscosity grade. Minimum concentration of cellulose ether in the aqueous solution is also desirable in that less residual cellulose ether needs to be washed away or burned off the mat of metal fibers formed by vacuum molding the aqueous viscous dispersion thereof.

The viscosity of the aqueous solution to be used for dispersing a selected type of metal fibers therein should accommodate two opposite desiderata: high enough to keep the dispersed metal fibers as a reasonably uniform suspension and low enough to facilitate the separation of the solution from the metal fibers during the vacuum molding procedure. Simple tests with the selected metal fibers and aqueous cellulose ether solutions of different viscosities can be performed to determine a practical compromise viscosity that serves the aforesaid opposite desiderata.

It is well known that a pore former may be used to provide desired porosity of the vacuum molded mat of metal fibers. Fine particles of methyl methacrylate is a prominent example of pore former. The pore former is dispersed like the metal fibers in the viscous aqueous solution of cellulose ether. By heating the vacuum molded layer or mat of metal fibers deposited on the foraminous support, the methyl methacrylate is eliminated by vaporization and combustion.

A burner face of sintered metal fibers produced by this invention can provide flameless surface combustion and is notable for structural ruggedness, radiant efficiency, and low emissions of nitrogen oxides (NOx), carbon monoxide and unburned hydrocarbons. The strength of the sintered metal fiber mat makes it possible to perforate it so that it can yield both radiant surface combustion and blue flame combustion simultaneously.

Such dual type combustion is described in U.S. Pat. No. 5,439,372 to Duret et al.

Comparing a burner made in accordance with this invention with a ceramic fiber burner of the type disclosed in U.S. Pat. No. 3,383,159 to Smith, it is not only structurally stronger and has a longer service life but also can operate at higher temperatures.

The metal fibers selected for a burner face are made of a metal that is resistant to the high temperature and oxidizing conditions to which it will be exposed when placed in service. While the selected metal fiber may undergo surface oxidation, it must be resistant to progressive oxidation which would lead to disintegration or pulverization of the fiber.

Iron-based and nickel-based alloys are well suited for fibers in the burner of this invention. Iron-aluminum alloys are frequently favored. Nickel-chromium alloys are another alloy type that can provide fibers with the desired resistance to high temperature and oxidation. Preferred iron-aluminum alloys contain by weight 4% to 10% aluminum, 16% to 24% chromium, 0% to 26% nickel and often fractional percentages of yttrium and silicon. Preferred nickel-chromium alloys contain by weight 15% to 30% chromium, 0% to 5% aluminum, 0% to 8% iron and often fractional percentages of yttrium and silicon. The preferred alloys contain chromium.

Of course, the selection of metal fibers for the production of filters is based on different criteria such as corrosion resistance and even low cost.

The metal fiber diameter is generally less than about 50 microns and usually in the range of about 8 to 25 microns while the fiber length is in the range of about 0.1 to 3 millimeters. The metal fibers may be straight or curled.

The aqueous viscous solution of cellulose ether is prepared by dissolving one or more varieties of cellulose ether in cold water by swelling and subsequent hydration. Not only may different cellulose ethers be mixed but also the different ethers may have different viscosity grades. For example, methylcellulose of 1500 centipoise grade may be mixed with hydroxypropyl methylcellulose of 15,000 centipoise grade in proportions to yield a water solution with a viscosity of 4000 centipoises while keeping the total concentration of the ethers at only 1.5%.

Metal fibers are usually supplied as clumps of fibers which must be opened up to free the individual fibers. A preferred way of releasing metal fibers from the clumps thereof is to drop the clumps in a viscous aqueous solution of cellulose ether which is undergoing high speed mixing of the type that does not draw in air and cause excess foaming of the cellulose ether solution. Turbo-dispersers having turbine impellers within a housing at the bottom of vessels achieve metal fiber dispersion in a cellulose ether solution without troublesome foaming.

The foraminous supports on which metal fibers are deposited by vacuum molding the viscous aqueous dispersion thereof are most often metallic but may be ceramic. Porous and perforated ceramic supports make it possible to produce sintered metal fiber porous mats that can be separated from the supports and used, for example, as filters without support. Usually, a foraminous metal support serves not only to provide the surface on which the metal fibers are deposited by vacuum molding but also to become bonded to the fiber mat when sintered. Metal screens are popular supports and perforated metal sheets are alternate supports.

DESCRIPTION OF A PREFERRED EMBODIMENT

A radiant surface combustion burner face is produced pursuant to the invention by dispersing 18 grams of metal fiber in each gallon of a water solution containing 1.2% by weight of methylcellulose and hydroxypropyl methylcellulose proportioned to yield a viscosity of 2200 centipoises. The metal fiber is an iron-aluminum alloy containing by weight 5.5% aluminum, 22% chromium and less than 0.5% yttrium and silicon.

The viscous aqueous dispersion of metal fibers is vacuum molded on the inner side of a stainless steel screen shaped as a cylinder with a 4-inch diameter and 12-inch length. Vacuum molding is stopped when the fiber mat is 0.4 inch thick. Promptly, the fiber mat on the screen support is placed in a water bath and subjected to vacuum washing to eliminate the cellulose ethers.

The washed fiber mat and screen support are dried and placed in a annealing oven to sinter the metal fibers to one another and to the metal screen support.

This example illustrates an outstanding advantage of the invention, namely, it is as easy to produce curved fiber mats as it is to form flat mats. In fact, foraminous supports of various contours can be used pursuant to the invention to form fiber mats of varied shapes. For example, U.S. Pat. No. 5,211,552 to Krill et al shows two cylindrical porous ceramic fiber burners wherein the fiber layer is on the outer side of one cylindrical screen and the fiber layer is on the inner side of another cylindrical screen. Both types of cylindrical burners can now be made with metal fibers because of this invention. No prior art is known that could simply form curved sintered metal fiber mats. Other mat contours such as conical or paraboloidal are also now readily made by the process of this invention.

To summarize, for economic reason and post elimination from the vacuum molded metal fiber mat, the cellulose ether concentration in the water should preferably not be more than about 2% by weight. The viscosity of the aqueous cellulose ether solution is preferably at least about 1500 centipoises and usually does not exceed about 4000 centipoises. Methylcellulose and/or hydroxypropyl methylcellulose in various viscosity grades are most often selected to achieve the aforesaid preferred concentration and viscosity ranges. A desirable target is forming aqueous solutions of cellulose ethers having a viscosity of about 2500 centipoises and containing only about 1% by weight of cellulose ethers.

Variations and modifications of the invention will be apparent to those skilled in the art without departing from the spirit or scope of the invention. Accordingly, only such limitations should be imposed on the invention as are set forth in the appended claims.

What is claimed is:

1. A method of forming a sintered metal fiber porous mat which comprises dispersing metal fibers in an aqueous solution containing at least one water-soluble cellulose ether and having a viscosity of at least about 1500 centipoises, vacuum molding the resulting dispersion of said metal fibers on a foraminous support, eliminating residual aqueous solution of cellulose ether from the vacuum molded porous mat of metal fibers, and sintering said porous mat of metal fibers.

2. The method of claim 1 wherein residual aqueous solution of cellulose ether is cellulose ether is eliminated from the vacuum molded porous mat of metal fibers by vacuum washing said porous mat and drying the washed porous mat.

3. The method of claim 1 wherein residual aqueous solution of cellulose ether is eliminated from the vacuum molded porous mat of metal fibers by high temperature combustion with excess oxygen.

4. The method of claim 1 wherein the aqueous solution of water-soluble cellulose ether has a viscosity not exceeding about 4000 centipoises.

5. The method of claim 1 wherein a cellulose ether has a viscosity grade of at least about 1500 centipoises and is selected from the group consisting of methylcellulose and hydroxypropyl methylcellulose.

6. The method of claim 1 wherein the vacuum molded porous mat of metal fibers is compacted prior to sintering.

7. The method of claim 5 wherein the aqueous solution of methylcellulose and/or hydroxypropyl methylcellulose has a viscosity not exceeding about 4000 centipoises and contains not more than about 2% by weight of said methylcellulose and/or hydroxypropyl methylcellulose.

8. The method of claim 7 wherein the vacuum molded porous mat of metal fibers is vacuum washed and dried prior to sintering.

9. The method of claim 8 wherein the metal fibers are made of an alloy selected from the group consisting of iron-based and nickel-based alloys, and the foraminous support is a stainless steel screen.

10. The method of claim 5 wherein the foraminous support is a metal screen shaped as a cylinder.

11. The method of claim 5 wherein the aqueous solution of methylcellulose and/or hydroxypropyl methylcellulose has a viscosity of about 2500 centipoises and contains about 1% by weight of methylcellulose and/or hydroxypropyl methylcellulose.

12. The method of claim 2 wherein the foraminous support is a metal screen shaped as a cylinder.

13. The method of claim 12 wherein the dispersion of metal fibers is vacuum molded on the inner side of the cylindrically shaped metal screen.

14. A radiant surface combustion burner face in the form of a cylinder, which comprises a stainless steel screen shaped as a hollow cylinder, and a porous layer of metal fibers vacuum molded from a viscous aqueous dispersion of only said metal fibers on the cylindrical screen and sintered thereto, the metal fibers being resistant to the high temperatures and oxidizing conditions to which said burner face will be exposed.

15. The burner face of claim 14 wherein the porous layer of metal fibers is sintered to the inner side of the cylindrical screen.

16. A method of producing a sintered metal fiber porous mat which comprises dispersing metal fibers in a viscous aqueous solution of a water-soluble cellulose ether, pressurized filtration of said viscous solution containing the dispersed metal fibers on a foraminous support to form thereon a porous mat of said metal fibers, eliminating residual aqueous solution of said cellulose ether from said porous mat, and sintering said porous mat of metal fibers.

17. The method of claim 16 wherein the elimination of residual aqueous solution of cellulose ether from the porous mat of metal fibers is effected by pressurized washing.

18. The method of claim 17 wherein pressurized filtration and pressurized washing are conducted by applying vacuum to the discharge side of the foraminous support.

19. The method of claim 17 wherein the viscous aqueous solution contains about 1% by weight of methylcellulose and/or hydroxypropyl methylcellulose and has a viscosity of about 2500 centipoises.

20. The method of claim 16 wherein the foraminous support is a metal screen shaped as a cylinder.

21. A radiant surface combustion burner face comprising a stainless steel screen, and a porous mat of metal fibers deposited on said screen by pressurized filtration of a dispersion of only said metal fibers in a viscous aqueous solution of methylcellulose and/or hydroxypropyl methylcellulose and bonded to said screen by sintering.

22. The burner of claim 21 wherein the screen is shaped as a cylinder and the porous mat of metal fibers is bonded to the inner side of said cylinder.

23. The method of claim 1 wherein the dispersing of the metal fibers in an aqueous solution containing a cellulose ether is carried out with a turbo-disperser.

24. The method of claim 5 wherein the dispersing of the metal fibers in an aqueous solution containing methylcellulose and/or hydroxypropyl methylcellulose is carried out with a turbo-disperser.

25. The method of claim 16 wherein the dispersing of the metal fibers in an aqueous solution of a cellulose ether is carried out with a turbo-disperser.

26. A radiant surface combustion burner face which comprises a metal screen, and a porous layer of metal fibers formed on said screen by pressurized filtration of a viscous aqueous dispersion of only said metal fibers and sintered to said screen, said metal fibers being resistant to the high temperatures and oxidizing conditions to which said burner face will be exposed.

27. The burner face of claim 26 wherein the metal screen is shaped as a cylinder and the porous layer of metal fibers is sintered to the outer side of said cylinder.

* * * * *